US011303063B2

(12) United States Patent
Narro et al.

(10) Patent No.: US 11,303,063 B2
(45) Date of Patent: Apr. 12, 2022

(54) ELECTRICAL CONNECTOR WITH RETRACTABLE TERMINAL-STABILIZER

(71) Applicant: Delphi Technologies, Inc., Troy, MI (US)

(72) Inventors: Roberto C. Narro, Coahuila (MX); Marcelino Hernandez, Coahuila (MX)

(73) Assignee: APTIV TECHNOLOGIES LIMITED

( * ) Notice: Subject to any disclaimer, the term of this patent is extended or adjusted under 35 U.S.C. 154(b) by 255 days.

(21) Appl. No.: 16/610,690

(22) PCT Filed: Apr. 24, 2018

(86) PCT No.: PCT/US2018/029082

§ 371 (c)(1),
(2) Date: Nov. 4, 2019

(87) PCT Pub. No.: WO2018/208499

PCT Pub. Date: Nov. 15, 2018

(65) Prior Publication Data

US 2021/0184398 A1 Jun. 17, 2021

Related U.S. Application Data

(63) Continuation of application No. 15/588,777, filed on May 8, 2017, now Pat. No. 10,236,629.

(51) Int. Cl.
*H01R 13/629* (2006.01)
*H01R 13/631* (2006.01)
(Continued)

(52) U.S. Cl.
CPC ..... *H01R 13/629* (2013.01); *H01R 13/518* (2013.01); *H01R 13/62938* (2013.01); *H01R 13/631* (2013.01); *H01R 13/639* (2013.01)

(58) Field of Classification Search
CPC .. H01R 13/629; H01R 13/518; H01R 13/631; H01R 13/639
(Continued)

(56) References Cited

U.S. PATENT DOCUMENTS 5,263,871 A * 11/1993 Sano ..... H01R 13/62933 439/157
5,437,558 A * 8/1995 Sakuraoka ..... H01R 13/631 439/140
(Continued)

FOREIGN PATENT DOCUMENTS

CN 101295849 A 10/2008
JP 2605189 B2 8/1991
(Continued)

OTHER PUBLICATIONS

Chinese Office Action based on CN Application No. 201880030401 dated Sep. 2, 2020, 5 pages.
Search Report based on CN Application No. 201880030401.

*Primary Examiner* — Alexander Gilman
(74) *Attorney, Agent, or Firm* — Billion & Armitage

(57) ABSTRACT

An electrical connector includes a mating connector in which a plurality of electrical terminals are disposed. The mating connector defines a connector shroud configured to receive a corresponding connector. The electrical connector also includes a terminal stabilizer defining a plurality of terminal apertures surrounding the electrical terminals disposed within the connector shroud. The terminal stabilizer is configured to move from a prestaged position to a seated position when the connector is inserted within the connector shroud and is further configured to move from the seated position to the prestaged position when the connector is removed from the connector shroud.

20 Claims, 6 Drawing Sheets

(51) Int. Cl.
*H01R 13/518* (2006.01)
*H01R 13/639* (2006.01)

(58) Field of Classification Search
USPC ..... 439/367
See application file for complete search history.

(56) References Cited

U.S. PATENT DOCUMENTS 5,715,135 A 2/1998 Brussalis et al.
5,788,529 A 8/1998 Borzi et al.
5,961,337 A 10/1999 Kordes
6,220,876 B1 4/2001 Avila et al.
6,422,881 B1 * 7/2002 Puhl ..... H01R 13/4538 439/140
6,692,274 B2 * 2/2004 Maegawa ..... H01R 13/62933 439/157
6,739,889 B1 5/2004 Daggett et al.
6,761,568 B2 * 7/2004 Bakker ..... H01R 13/631 439/140
6,821,135 B1 * 11/2004 Martin ..... H01R 13/629 439/141
6,976,858 B1 12/2005 Kikuchi et al.
7,179,136 B1 2/2007 Morello
7,267,562 B2 * 9/2007 Katsuma ..... H01R 13/516 439/140
7,578,709 B2 8/2009 Daudin et al.
7,635,212 B2 12/2009 Seidler
7,670,177 B2 3/2010 Myer et al.
8,038,455 B1 * 10/2011 Moraes ..... H01R 13/4538 439/140
8,267,702 B2 * 9/2012 De La Reza ..... B60R 16/0238 439/76.1
8,267,704 B2 9/2012 Cheng et al.
8,926,344 B2 1/2015 Jozwiak et al.
9,054,454 B2 6/2015 Gomez et al.
9,509,081 B2 * 11/2016 Kobayashi ..... H01R 13/506
9,520,669 B2 12/2016 Gerwatowski et al.
9,748,692 B1 8/2017 Pardo
10,193,276 B1 * 1/2019 Lanzotti ..... H01R 13/4368
10,236,629 B2 * 3/2019 Narro ..... H01R 13/639
10,305,218 B2 * 5/2019 Griepenstroh ..... H01R 13/506
10,498,066 B1 * 12/2019 Sundarakrishnamachari ..... H01R 13/426
10,763,610 B2 * 9/2020 Bae ..... H01R 13/502
2002/0168895 A1 * 11/2002 Suzuki ..... H01R 13/4365 439/595
2003/0068910 A1 * 4/2003 Casses ..... H01R 13/62933 439/157
2010/0105254 A1 * 4/2010 Park ..... H01R 13/4538 439/752
2013/0007935 A1 * 1/2013 Chin ..... B64G 1/005 2/2.13
2018/0323538 A1 * 11/2018 Narro ..... H01R 13/629

FOREIGN PATENT DOCUMENTS

JP 2016042455 A 3/2016
KR 20130046127 5/2013

* cited by examiner

ELECTRICAL CONNECTOR WITH RETRACTABLE TERMINAL-STABILIZER

CROSS REFERENCE TO RELATED APPLICATION

This application is a national stage application under 35 U.S.C. § 371 of PCT Application Number PCT Application Number PCT/US18/29082 having an international filing date of Apr. 24, 2018, which designated the United States, said PCT application claiming the benefit of U.S. patent application Ser. No. 15/588,777, now U.S. Pat. No. 10,236,629, filed on May 8, 2017, the entire disclosure of each which is hereby incorporated by reference.

TECHNICAL FIELD OF INVENTION

This disclosure generally relates to an electrical connector assembly, and more particularly relates to an electrical connector assembly having a retractable terminal-stabilizer device.

BACKGROUND OF INVENTION

An electrical distribution center is typically used in automotive vehicles to interconnect various electrical wiring assemblies. The electrical distribution center assembly may also be used in other non-vehicular applications. The typical electrical distribution center may package various fuses, relays, and other electrical devices, in a central location and may include provisions for electrically connecting a power source to electrical wiring harnesses that supply power and control signals to various electrical systems of the vehicle. Examples of electrical distribution centers may be found in U.S. Pat. No. 5,715,135 granted to Brussalis et al., U.S. Pat. No. 5,788,529 granted to Borzi et al., U.S. Pat. No. 6,220,876 granted to Avila et al., U.S. Pat. No. 6,739,889 granted to Daggett et al., and U.S. Pat. No. 7,635,212 granted to Seidler.

A known electrical distribution center that incorporates a connector shroud includes a non-movable floor positioned at the base of male blade electrical terminals to provide some level of blade dimensional stabilization prior to mating with a wiring harness connector. For additional blade stabilization and protection from damage prior to connector mating, a separate electrical terminal stabilizer plate is mounted to the shroud to capture the terminals near the terminal tips. Terminal stabilizer plates also function to keep undesired foreign matter, or debris out of the connector system environment to prevent intermittent electrical connections between the mated terminals, and to prevent blockage between the connectors that may impede the mating of the connection system. The terminal stabilizer plate may be attached using tabs that are inserted into slots in the shroud as shown in U.S. Pat. No. 6,422,881 granted to Puhl, et al.

The terminal stabilizer plate may be integrally molded into shroud with breakaway portions, as shown in U.S. Pat. No. 8,267,704 granted to De La Reza et al. In this design, when the connector body is mated to the electrical distribution center, there is a momentary increase in force needed to insert the connector body into the shroud as the tabs are pushed out of the slots or the breakaway portions are broken.

Jozwiak shows, in U.S. Pat. No. 8,926,344, a terminal stabilizer plate held in the shroud at a ready position by a releasable latch means. In this design, when the connector body is mated to the electrical distribution center, the terminal stabilizer plate is pushed out of flexible locks and toward the connector floor to the base of the terminals.

A retractable terminal stabilizer plate typically couples with the mating connector such that the stabilizer plate moves back to the ready position when the mating connectors is removed. Current retractable stabilizer plate connection systems typically require an undesired high coupling force during the process of mating and unmating of connection system. Reducing the coupling force to operate the retractable stabilizer reduces the overall coupling force needed to mate and unmate the connection system. As current connection system configurations age over their useful service life in an application, the elements of the connection system, including the retractable stabilizer, may become fatigued to the point where the retractable stabilizer may not retract back to the ready position when the connection system is unmated. If the retractable stabilizer remains undesirably positioned deep in the mating connector when the connection system is unmated, an increased portion of the male terminals are exposed above the retractable stabilizer which increases the risk for male terminal damage. Damaged male terminals require servicing to the connection system which undesirably increases repair costs of the connection system.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

SUMMARY OF THE INVENTION

In accordance with one embodiment, an electrical connector assembly is provided. The electrical connector assembly includes a connector, a corresponding mating-connector, and a terminal-stabilizer. The connector has a plurality of electrical-terminals. The connector also has an outer-surface that includes a plurality of retraction-fins. The mating-connector has a plurality of mating-electrical-terminals. The mating-connector is releasably connected to the connector along a mating-axis. The electrical-terminals interconnect with the mating-electrical-terminals when the connector is moved from an unmated-position to a mated-position. The mating-connector includes a connector-shroud having side walls defining a shroud-cavity configured to receive the connector therein and a base. The terminal-stabilizer is slideably disposed within the shroud-cavity and includes a plurality of retraction-locks that engage the plurality of retraction-fins on the connector. The terminal-stabilizer defines a plurality of terminal-apertures that slideably engage the plurality of mating-electrical-terminals. The terminal-stabilizer is moveable from a prestaged-position, when the connector and the mating-connector are in the unmated-position, to a seated-position, when the connector is moved to the mated-position. The connector retracts the terminal-stabilizer from the seated-position to the prestaged-position when the connector is moved from the mated-position to the unmated-position.

Further features and advantages will appear more clearly on a reading of the following detailed description of the preferred embodiment, which is given by way of non-limiting example only and with reference to the accompanying drawings.

BRIEF DESCRIPTION OF DRAWINGS

The present invention will now be described, by way of example with reference to the accompanying drawings, in which.

DETAILED DESCRIPTION

Figure 1:
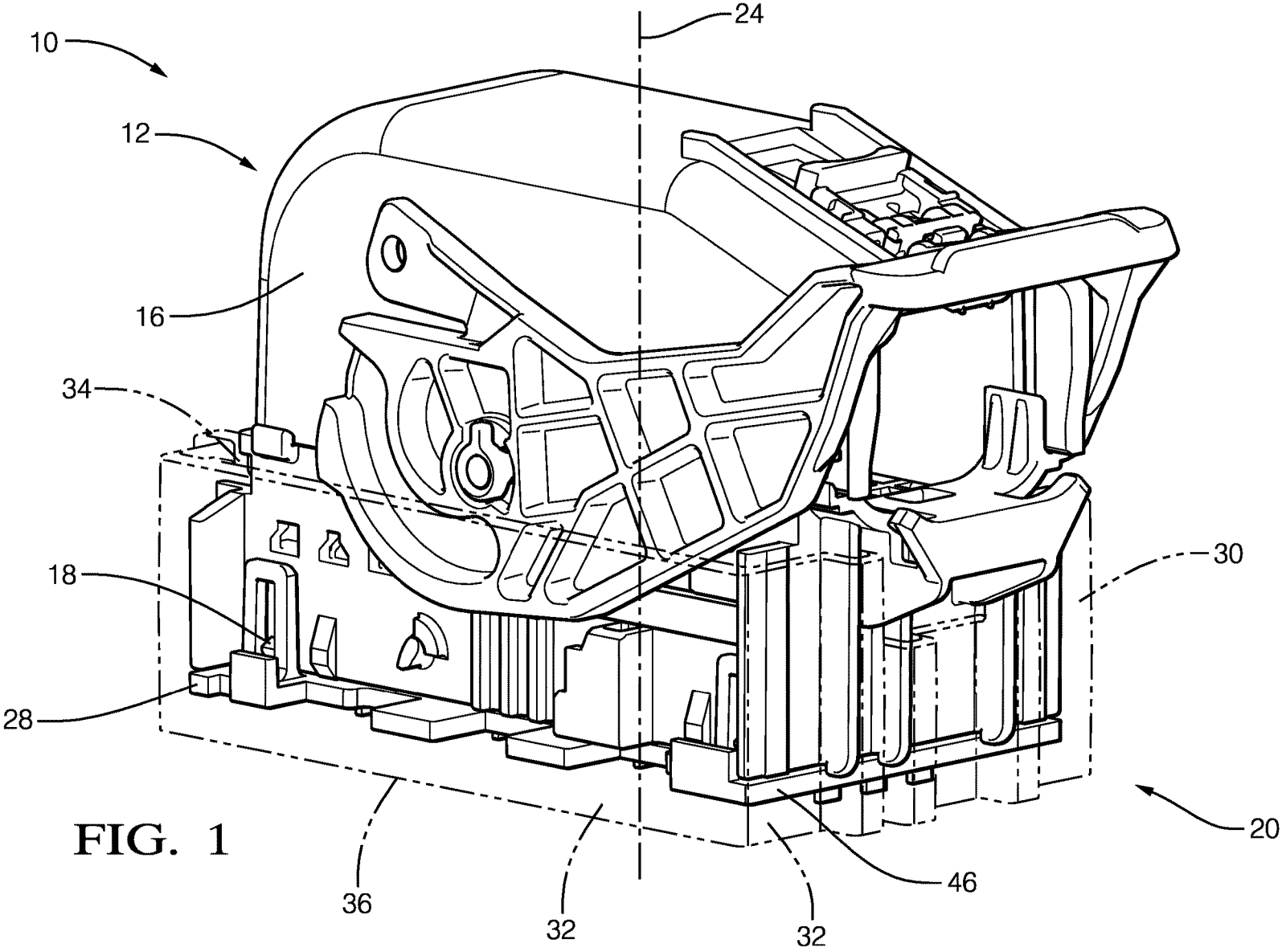
FIG. 1 is an illustration of a cut-away view of an electrical connector assembly in accordance with one embodiment.

FIG. 1 illustrates a non-limiting example of an electrical connector assembly 10, hereafter referred to as the assembly 10. The assembly 10 includes a connector 12 having a plurality of electrical-terminals 14 (see FIG. 5A), and an outer-surface 16 that has a plurality of retraction-fins 18.

Figure 2:
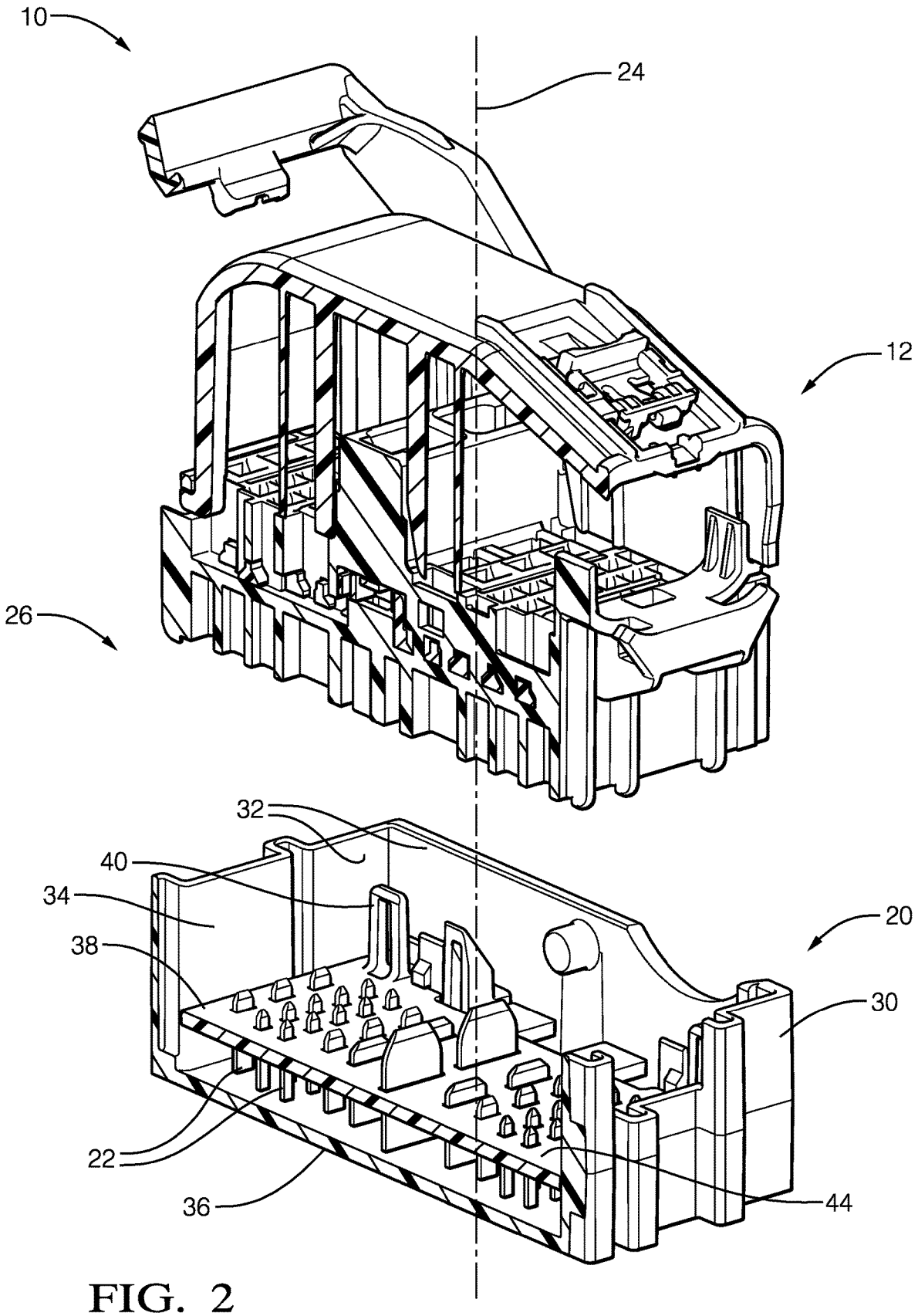
FIG. 2 is an illustration of a cross section view of the connector assembly of FIG. 1 in an unmated position in accordance with one embodiment.
Figure 6:
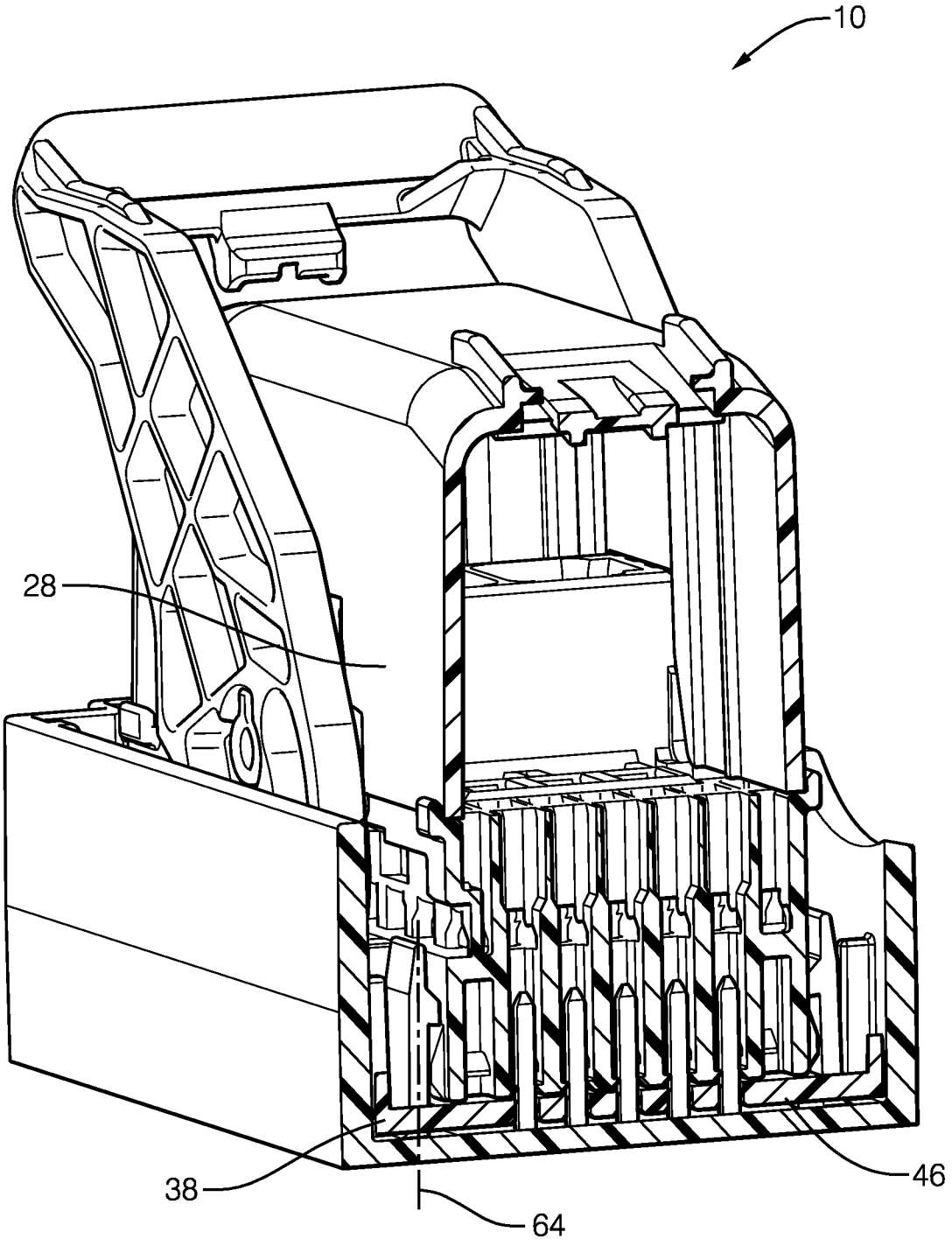
FIG. 6 is a cross section view of an illustration of the connector assembly of FIG. 1 in a mated-position with the terminal-stabilizer in a seated-position in accordance with one embodiment.

The assembly 10 also includes a corresponding mating-connector 20 having a plurality of mating-electrical-terminals 22 (see FIG. 2). The mating-connector 20 is releasably connected to the connector 12 along a mating-axis 24 such that the electrical-terminals 14 mate with the mating-electrical-terminals 22 when the connector 12 is moved from an unmated-position 26 (see FIG. 2) to a mated-position 28 (see FIG. 6). The mating-connector 20 includes a connector-shroud 30 having side walls 32 that define a shroud-cavity 34 configured to receive the connector 12, and a base 36.

Figure 3A:
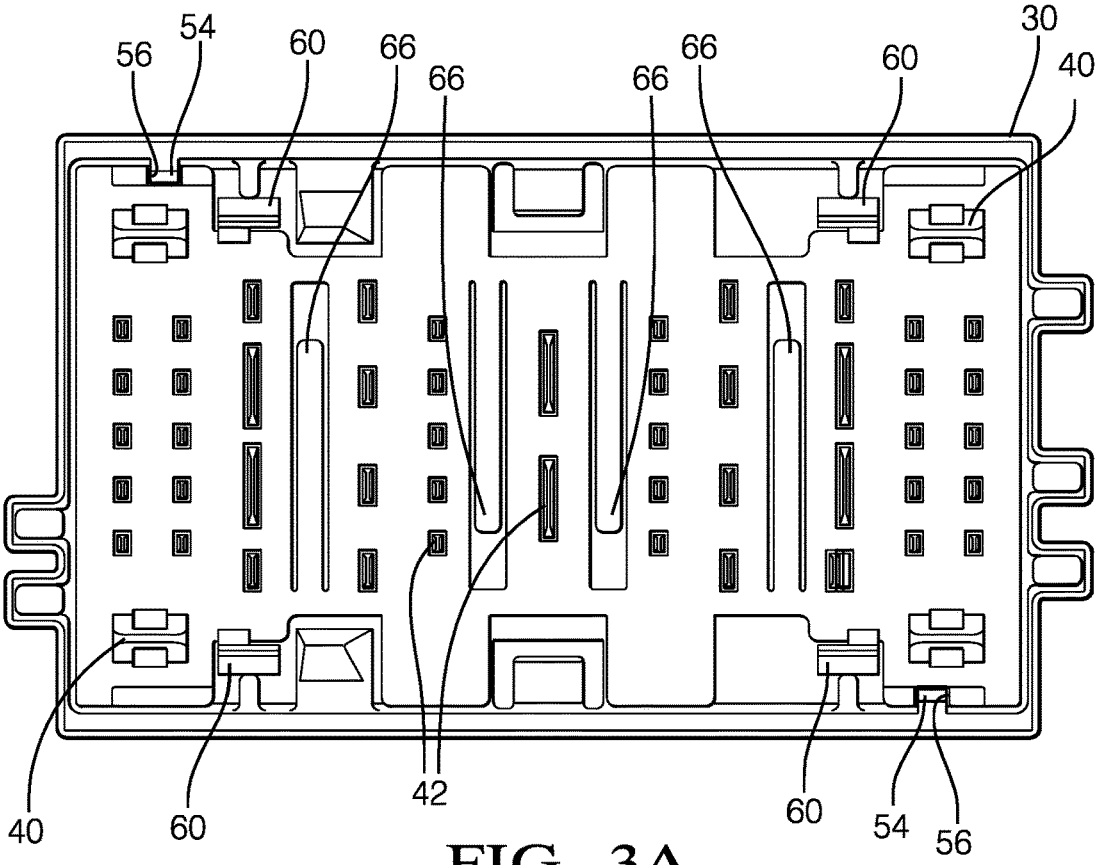
FIG. 3A is an illustration of the terminal-stabilizer disposed of FIG. 2 within the mating-connector of FIG. 2 in accordance with one embodiment.
Figure 3B:
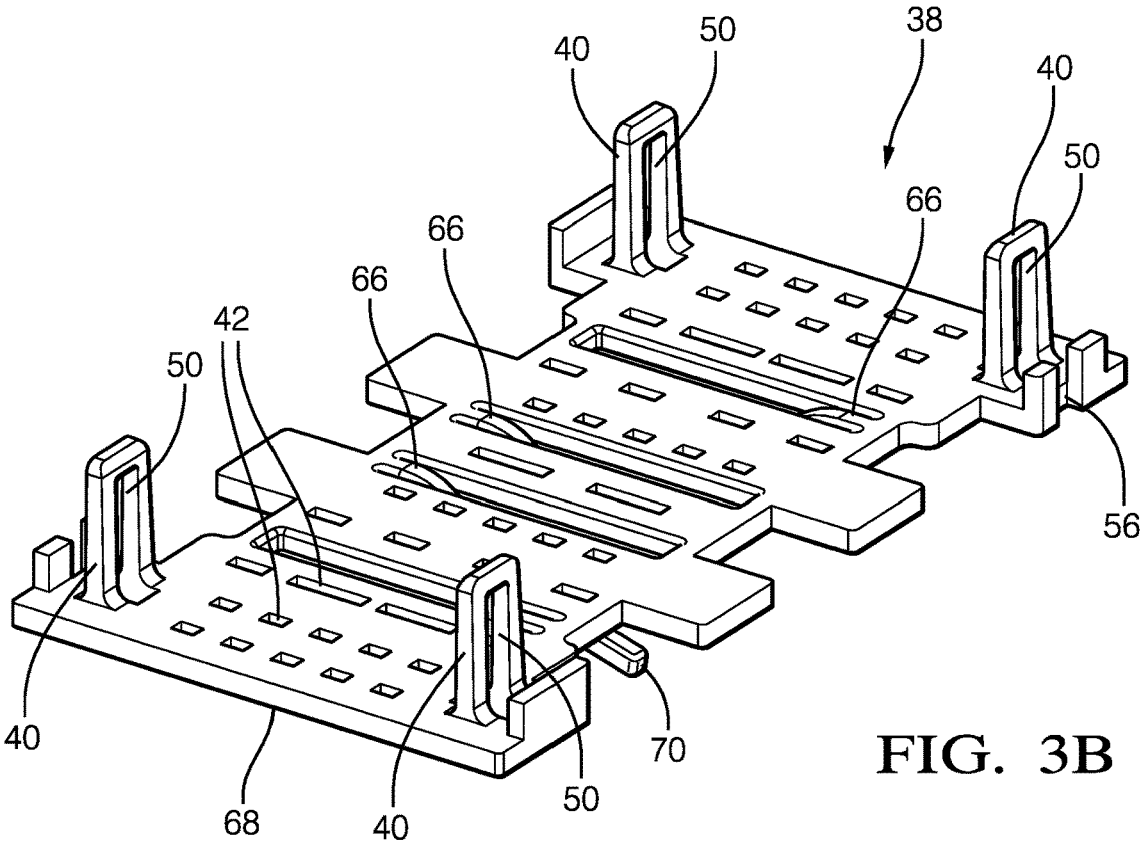
FIG. 3B is an illustration of the terminal-stabilizer of FIG. 2 in accordance with one embodiment.
Figure 4:
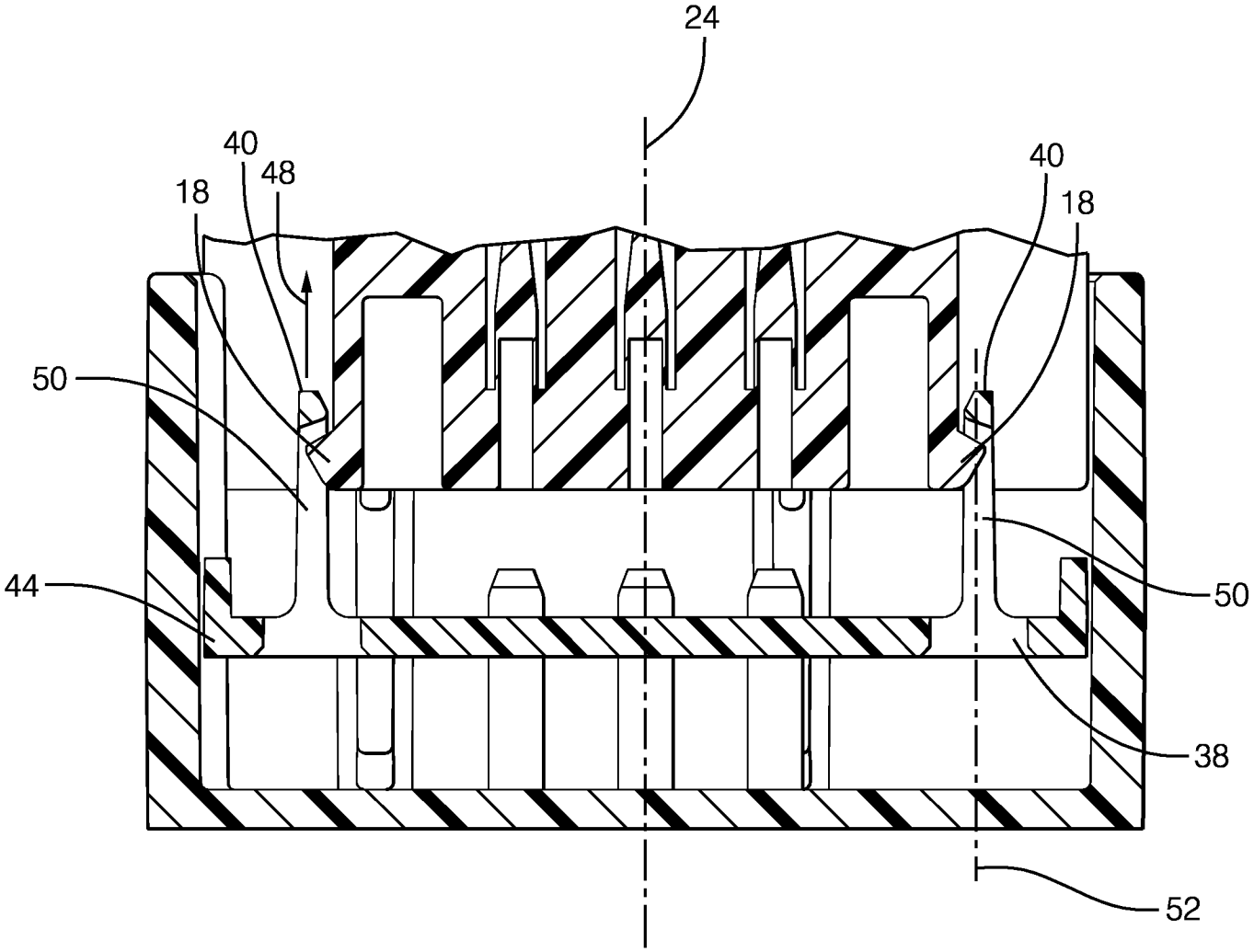
FIG. 4 is an illustration of the connector of FIG. 1 with retraction-fins engaged with retraction-locks of the terminal-stabilizer of FIG. 2 in accordance with one embodiment.

The assembly 10 also includes a terminal-stabilizer 38 (see FIG. 2) slideably disposed within the shroud-cavity 34 that includes a plurality of retraction-locks 40. The terminal-stabilizer 38 defines a plurality of terminal-apertures 42 (see FIGS. 3A and 3B) that slideably engage the plurality of mating-electrical-terminals 22. The retraction-locks 40 may releasably engage the plurality of retraction-fins 18 on the connector 12 when the connector 12 is inserted into the mating-connector 20, as illustrated in FIG. 4. The terminal-stabilizer 38 is moveable from a prestaged-position 44, when the connector 12 and the mating-connector 20 are in the unmated-position 26 (see FIG. 2) to a seated-position 46 when the connector 12 is moved to the mated-position 28 (see FIG. 1).

The connector 12 may retract 48 the terminal-stabilizer 38 from the seated-position 46 to the prestaged-position 44 when the connector 12 is moved from the mated-position 28 to the unmated-position 26 (see FIG. 4). Retracting 48 the terminal-stabilizer 38 to the prestaged-position 44 is advantageous because the terminal-stabilizer 38 may protect the mating-electrical-terminals 22 when the assembly 10 must be disconnected during periods of service. The retraction-fins 18 remain engaged with the retraction-locks 40 until the connector 12 is separated from the mating-connector 20. The retraction-fins 18 are configured with ramps (not specifically shown) on a leading-edge and a trailing-edge that displace the retraction-locks 40 perpendicular to the mating-axis 24 until the retraction-fins 18 are engaged and/or disengaged from the retraction-locks 40. The retraction-locks 40 define a retraction-slot 50 (see FIG. 3B) that slideably retains the retraction-fins 18 and enables the connector 12 to travel to the mated-position 28 with minimal frictional resistance. The retraction-locks 40 may return to a neutral flex-position 52 (see FIG. 4) that does not have a deflection from perpendicular to the mating-axis 24 when the retraction-locks 40 retain the retraction-fins 18.

The connector-shroud 30 may include a plurality of index-beams 54 and the terminal-stabilizer 38 may include a plurality of corresponding index-slots 56 (see FIGS. 3A and 3B) that slideably engage the plurality of index-beams 54. The index-beams 54 ensure a correct installation position of the terminal-stabilizer 38 in the connector-shroud 30 and may prevent any misalignment of the terminal-stabilizer 38 while the connector 12 is moved from the mated-position 28 to the unmated-position 26.

Figure 5B:
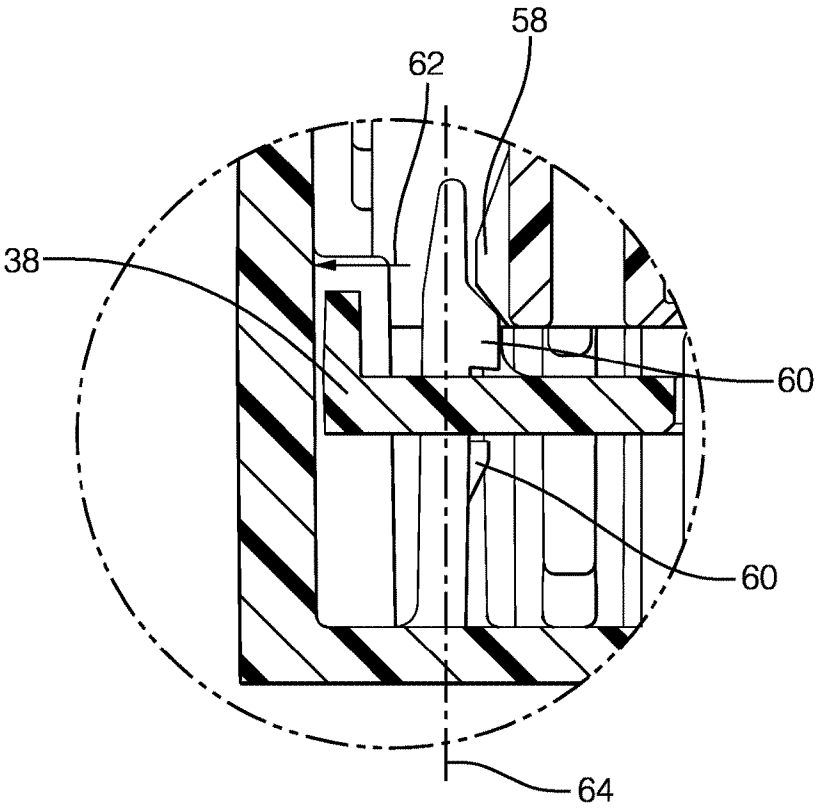
FIG. 5B is a close-up view of the release-ramps and beam-locks of FIG. 5A in accordance with one embodiment.
Figure 5A:
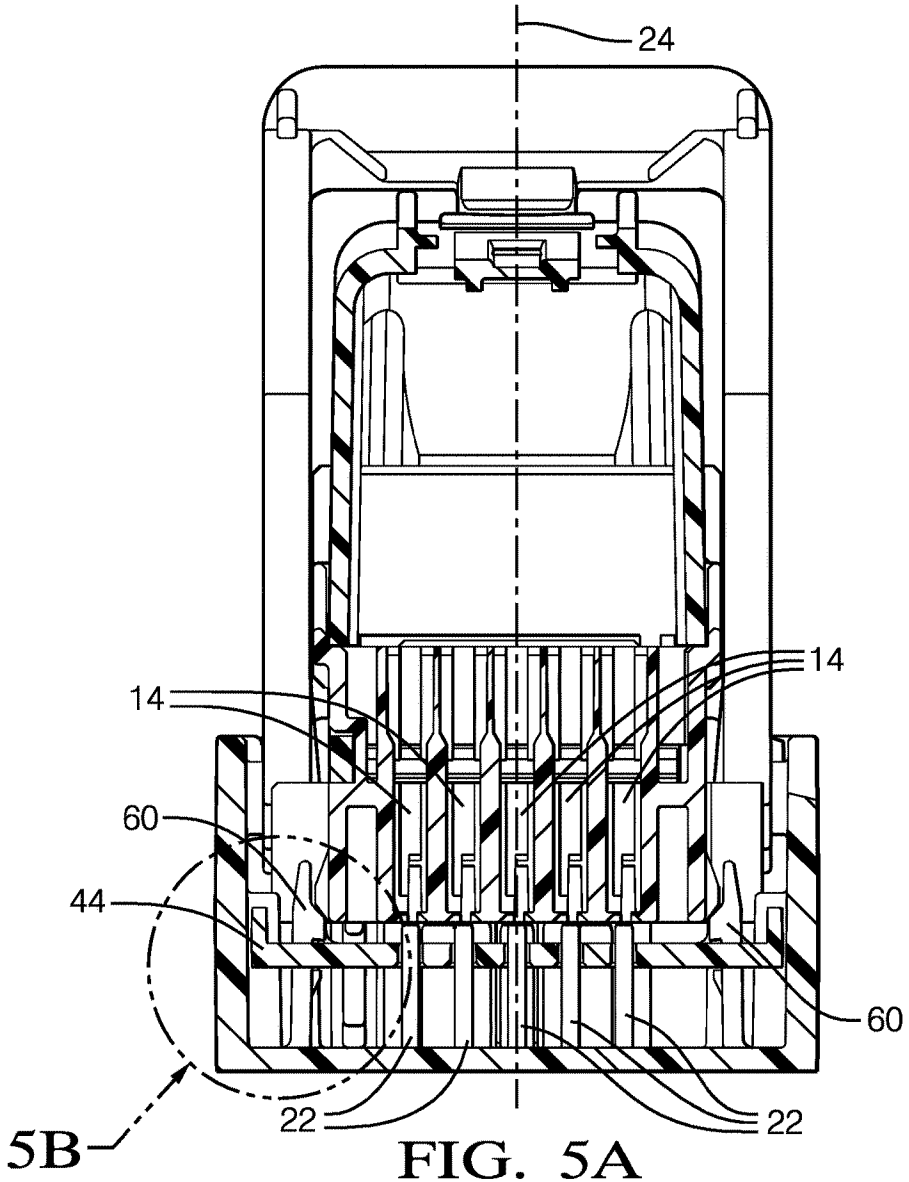
FIG. 5A is an illustration of the electrical connector assembly of FIG. 1 with release-ramps and beam-locks in accordance with one embodiment.

The connector 12 may also include a plurality of release-ramps 58, and the base 36 may also include a plurality of corresponding beam-locks 60 configured to retain the terminal-stabilizer 38 in the prestaged-position 44 (see FIGS. 5A and 5B). The beam-locks 60 prevent movement of the terminal-stabilizer 38 until the retraction-fins 18 engage the retraction-locks 40, and the plurality of release-ramps 58 displace the plurality of beam-locks 60 in a lateral direction 62 perpendicular to the mating-axis 24. The displacement of the beam-locks 60 enables the terminal-stabilizer 38 to move to the seated-position 46 (see FIG. 6) when the connector 12 is moved from the unmated-position 26 to the mated-position 28. The beam-locks 60 may return to a relaxed-position 64 that do not have a deflection from perpendicular to the mating-axis 24 after the terminal-stabilizer 38 is moved to the seated-position 46 (see FIG. 6). When the connector 12 is moved from the mated-position 28 to the unmated-position 26 the retraction-fins 18 retract 48 the terminal-stabilizer 38 until the beam-locks 60 capture edges of the terminal-stabilizer 38 and a pull-out force on the connector 12 exceeds the force required to retain the retraction-fins 18 within the retraction-locks 40, thus disconnecting the assembly 10.

The terminal-stabilizer 38 may further include a resilient member 66 (see FIGS. 3A and 3B) projecting from a bottom-surface 68 of the terminal-stabilizer 38 configured to exert a spring force on the base 36 in order to urge the terminal-stabilizer 38 from the seated-position 46 to the prestaged-position 44. The resilient member 66 may be characterized as having an arcuate shape 70. The terminal-stabilizer 38 may also include a plurality of resilient members 66 projecting from the bottom-surface 68 of the terminal-stabilizer 38 configured to urge the terminal-stabilizer 38 from the seated-position 46 to the prestaged-position 44.

Accordingly, an electrical connector assembly 10 provided. The electrical connector assembly 10 includes the retractable terminal-stabilizer 38 that reduces the overall coupling force needed to mate and unmate the connection system, compared to prior art retractable terminal stabilizers, by eliminating any breakaway features molded into the terminal stabilizer. The release-ramps 58 integrated into the connector 12 further reduce the overall coupling force needed to mate and unmate the connection system by reducing the frictional forces generated through the interaction with the ramp features of the beam-locks 60. The terminal-stabilizer 38 retraction-locks 40 and the mating-connector 20 beam-locks 60 return to the position having no deflection perpendicular to the mating-axis 24 after the terminal-stabilizer 38 is moved to the seated-position 46.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items. Additionally, directional terms such as upper, lower, etc. do not denote any particular orientation, but rather the terms upper, lower, etc. are used to distinguish one element from another and locational establish a relationship between the various elements.

We claim:

1. An electrical connector comprising:

a mating connector in which a plurality of mating electrical terminals is disposed, the mating connector defining a connector shroud configured to receive a corresponding connector in which a plurality of electrical terminals is disposed; and a terminal stabilizer defining a plurality of terminal apertures surrounding the plurality of mating electrical terminals disposed within the connector shroud, the terminal stabilizer configured to move from a prestaged position to a seated position when the corresponding connector is inserted within the connector shroud and further configured to move from the seated position to the prestaged position when the corresponding connector is removed from the connector shroud, wherein the terminal stabilizer includes a retraction lock configured to engage a retraction fin defined by the corresponding connector and wherein the retraction fin is configured to pull the retraction lock as the corresponding connector is removed from the connector shroud, thereby urging the terminal stabilizer from the seated position to the prestaged position, further comprising the corresponding connector which defines the retraction fin.

2. The electrical connector in accordance with claim 1, wherein the retraction lock defines a retraction slot configured to receive the retraction fin and wherein the retraction lock returns to a neutral flexed position parallel to a mating axis of the mating connector and the corresponding connector when the retraction fin is received within the retraction slot.

3. The electrical connector in accordance with claim 1, wherein the connector shroud includes an index beam and wherein the terminal stabilizer includes an index slot that cooperates with the index beam to ensure a correct installation position of the terminal stabilizer in the connector shroud and prevent misalignment of the terminal stabilizer as it moves between the prestaged position and the seated position.

4. The electrical connector in accordance with claim 1, wherein the corresponding connector also includes a release ramp and wherein the mating connector also includes a beam lock configured to retain the terminal stabilizer in the prestaged position until the release ramp displaces the beam lock in an outward direction as the corresponding connector is inserted within the connector shroud, thereby enabling the terminal stabilizer to move to the seated position.

5. The electrical connector in accordance with claim 4, wherein the beam lock is in a relaxed position parallel to a mating axis of the mating connector and the corresponding connector when the terminal stabilizer is in the seated position.

6. The electrical connector in accordance with claim 1, further comprising the corresponding connector which defines the retraction fin.

7. An electrical connector, comprising:

a mating connector in which a plurality of mating electrical terminals is disposed, the mating connector defining a connector shroud configured to receive a corresponding connector in which a plurality of electrical terminals is disposed; and a terminal stabilizer defining a plurality of terminal apertures surrounding the plurality of mating electrical terminals disposed within the connector shroud, the terminal stabilizer configured to move from a prestaged position to a seated position when the corresponding connector is inserted within the connector shroud and further configured to move from the seated position to the prestaged position when the corresponding connector is removed from the connector shroud, wherein the terminal stabilizer further includes a resilient member projecting from a bottom surface of the terminal stabilizer configured to urge the terminal stabilizer from the seated position to the prestaged position as the corresponding connector is removed from the connector shroud.

8. The electrical connector in accordance with claim 7, wherein the resilient member is integrally formed with the terminal stabilizer and has an arcuate shape.

9. An electrical connector, comprising:

a mating connector in which a plurality of electrical terminals is disposed defining a connector shroud configured to receive a corresponding connector;

a terminal stabilizer disposed within the connector shroud defining a plurality of terminal apertures in which the plurality of electrical terminals is disposed; and means for moving the terminal stabilizer from a prestaged position to a seated position and returning the terminal stabilizer from the seated position to the prestaged position.

10. The electrical connector in accordance with claim 9, wherein the means for moving the terminal stabilizer is configured to move the terminal stabilizer from the prestaged position to the seated position when the corresponding connector is inserted within the connector shroud and is further configured to move the terminal stabilizer from the seated position to the prestaged position when the corresponding connector is removed from the connector shroud.

11. The electrical connector in accordance with claim 9, wherein the means for moving the terminal stabilizer is configured to pull the terminal stabilizer as the mating connector is removed from the connector shroud, thereby urging the terminal stabilizer from the seated position to the prestaged position.

12. The electrical connector in accordance with claim 9, wherein the means for moving the terminal stabilizer is configured to ensure a correct installation position of the terminal stabilizer in the connector shroud and prevent misalignment of the terminal stabilizer as it moves between the prestaged position and the seated position.

13. The electrical connector in accordance with claim 9, wherein the means for moving the terminal stabilizer is configured to retain the terminal stabilizer in the prestaged position until the corresponding connector is inserted within the connector shroud.

14. An electrical connector, comprising:

a mating connector having a plurality of mating electrical terminals and a connector shroud configured to receive a corresponding connector having a plurality of electrical terminals and defining a retraction fin; and a terminal stabilizer slideably disposed within the connector shroud and having a retraction lock that engages the retraction fin of the corresponding connector, the terminal stabilizer defining a plurality of terminal apertures that slideably engage the plurality of mating electrical terminals, said terminal stabilizer moveable from a prestaged position to a seated position as the corresponding connector is inserted within the connector shroud, wherein the retraction fin engages the retraction lock when in the terminal stabilizer is in the prestaged position and wherein the retraction fin and the retraction lock cooperate to retract the terminal stabilizer from the seated position to the prestaged position when the corresponding connector is removed from the connector shroud, wherein the terminal stabilizer further includes a resilient member projecting from a bottom surface of the terminal stabilizer configured to urge the terminal stabilizer from the seated position to the prestaged position.

15. The electrical connector in accordance with claim 14, wherein the retraction lock defines a retraction slot that slideably retains the retraction fin, wherein the retraction lock is in a neutral flex position when the retraction lock engages the retraction fin.

16. The electrical connector in accordance with claim 14, wherein the corresponding connector includes a release ramp and wherein the connector shroud includes a beam lock configured to retain the terminal stabilizer in the prestaged position and prevent a movement of the terminal stabilizer until the release ramp displaces the beam lock in an outward direction and enables the terminal stabilizer to move to the seated position when the corresponding connector is inserted within the connector shroud.

17. The electrical connector in accordance with claim 16, wherein the beam lock is in a relaxed position having no deflection perpendicular to a mating axis of the mating connector and the corresponding connector when the terminal stabilizer is in the seated position.

18. The electrical connector in accordance with claim 14, wherein the connector shroud includes an index beam and wherein the terminal stabilizer includes an index slots that slideably engages the index beam.

19. The electrical connector in accordance with claim 14, wherein the terminal stabilizer further includes a resilient member projecting from a bottom surface of the terminal stabilizer configured to urge the terminal stabilizer from the seated position to the prestaged position.

20. The electrical connector in accordance with claim 19, wherein the resilient member is characterized as having an arcuate shape.

* * * * *